United States Patent [19]

Dunkin

[11] 4,019,432

[45] Apr. 26, 1977

[54] RIVET MAKING MACHINE

[76] Inventor: Albert Dunkin, 12 Split Rock Road, South Norwalk, Conn. 06854

[22] Filed: Jan. 21, 1976

[21] Appl. No.: 651,149

[52] U.S. Cl. ..... 10/13

[51] Int. Cl.[2] ..... B21K 1/58

[58] Field of Search ..... 10/11 R, 11 T, 12 R, 10/12 T, 12.5, 13, 15, 25

[56] References Cited

UNITED STATES PATENTS

| | | | |
|---|---|---|---|
| 2,395,722 | 2/1946 | Buchet | 10/13 |
| 2,786,217 | 3/1957 | Johnson | 10/13 |
| 3,031,908 | 5/1962 | Lejdegard | 10/25 |
| 3,126,561 | 3/1964 | Orloff | 10/11 R |
| 3,200,423 | 8/1965 | Byam et al. | 10/12.5 |
| 3,547,334 | 12/1970 | Gwyn | 10/13 X |
| 3,551,926 | 1/1971 | Ferre | 10/13 |
| 3,635,389 | 1/1972 | Shibata | 10/27 R |
| 3,800,348 | 4/1974 | Dunkin | 10/11 T |

*Primary Examiner*—C.W. Lanham
*Assistant Examiner*—E. M. Combs
*Attorney, Agent, or Firm*—Lane, Aitken, Dunner & Ziems

[57] ABSTRACT

A rivet making machine and method in which a stationary set of angularly spaced head forming tools and a ram supported reciprocable set of body working tools are aligned at angularly spaced stations with each other and with a set of body dies carried by a rotatable indexing disc for successive positioning at the work stations. The body dies are independently movable axially of the indexing plate as necessary for cooperation of the head forming and body working tools on a blank carried by each body die. Blank cut-off is effected by a shearing die pair, one die pair being established at the end of each body die opposite the end thereof cooperating with the head forming tools. The other of the shearing die pair may be a fixed die in which relative movement of the shearing die pair is accomplished by indexing movement of the body dies. Alternatively, a shearing tool establishing the other die of the pair may be moved independently of body die indexing.

22 Claims, 12 Drawing Figures

RIVET MAKING MACHINE

BACKGROUND OF THE INVENTION

This invention relates to methods and apparatus for making rivets and other similarly shaped articles. More particularly, it concerns improvements in such methods and apparatus by which production rates are increased significantly over those of presently available machinery without compromise in other production parameters such as machinery costs, quality control and the like.

In the manufacture of such shaped articles as rivets (both solid and tubular), screws, bolts and the like, a cylindrical blank is first formed usually by severing a length of an elongated rod or wire and then subjected to successive forming or mechanical working operations until the desired final shape is achieved. Machines used for the production of such articles conventionally incorporate a transfer mechanism having a plurality of blank retaining holders and operable to transfer each blank sequentially to successive work stations at which tools are positioned for performing the work operations on each blank. The work stations are spaced to be in alignment with the path of blank holder movement so that each holder and thus each of a plurality of blanks will be presented at each work station. The transfer mechanism stops or dwells at each work station for a time necessary for all operations to be performed before indexing or incrementally moving to the next work station stop. After the first blank is worked to the final shape in this manner and ejected from the holder by which it was transferred through the successive work stations, a blank will be finally shaped and the resulting article ejected for each subsequent dwell period of the transfer mechanism.

The particular working or shaping operation performed at the respective working stations will vary, depending on the article to be formed. However, the formation of headed articles of the referenced type will usually involve cutting and/or loading a blank in a holder at one station, fixing the axial position of the blank in the holder at a second station by application of force to opposite ends of the blank and thus expanding the blank radially into engagement with the holder, shaping the head and body (such as in the formation of tubular rivets) progressively at succeeding stations again by tools which apply force to opposite ends of the blank and ejecting the finished article at a final station. Each of the blank holders, therefore, in addition to functioning as a carrier for transfer of each blank to the successive work stations, functions also as a body die which determines the precise exterior shank configuration of the article, e.g., the diameter and relative length of a rivet shank to be formed for a blank of a preestablished size.

Rivet making machines (a term of art applicable to machinery used to form screws, bolts and other such articles as well as rivets) currently in use for high speed production of shaped metal articles and which optimize the aforementioned principles of operation, may employ as a blank transfer mechanism a rotatable indexing plate positioned axially between reciprocable ram carried head shaping dies and a fixed bed or shoe supporting body punching pins or anvils. The blank holders or body dies are usually formed as open ended bores in the indexing plate or as die inserts fixed in the plate so that the respective ram mounted head shaping dies and bed mounted body pins can cooperate at opposite ends of each blank under ram force while the blanks are retained in position by the plate during each indexed or dwell position thereof. An exemplary disclosure of this type of machinery is found in U.S Pat. No. 2,786,217 issued Mar. 26, 1957 to Horace L. Johnson.

Although such machines are capable of high speed operation, the maximum production rate in practice is limited by two factors; (1) the duration of transfer mechanism or indexing plate dwell time required to perform the longest single operation and (2) the time required after completion of a working operation or ram stroke to move a blank from one work station to a successive work station at which it must be accurately positioned and fully stopped for the next ram stroke and resulting work operation. It is generally recognized that the operation requiring the longest dwell time is that of cutting and/or loading each indexing plate mounted holder or body die with a blank having a precise length. To achieve the necessary degree of blank length precision at high speeds, a shearing die pair is incorporated in rivet making machines to be driven in synchronism with the ram and plate indexing drive and preferably operated during the time the body die carrying plate is being indexed between stations for loading or during turret dwell periods. Such die cutting mechanisms are disclosed for example, in the aforementioned U.S. Pat. No. 2,786,217 and in U.S. Pat. No. 3,800,348 issued Apr. 2, 1974 to the present inventor. While blank cutting mechanisms of this type satisfy the requirement for blank length precision as well as reduce dwell time required for the blank loading operation, they tend to both complicate the overall machine in terms of number of controlled moving parts and increase the power requirements as a result of added moving part inertia.

The limitation on production speeds as a result of the time required to index the blank transfer mechanism from one station to the other is perhaps more significant than dwell time duration both because blank transfer time is non-productive time in the context of blank working operations and because of the inertial forces which must be accounted for in initiating and stopping index plate movement with precision. Also, blank holder indexing in prior rivet making machines required two directions of index plate movement; namely, axial movement to clear punch tools supported by the fixed bed of the machine and angular or rotational movement between the respective working stations at which the head forming dies and punch tools are aligned. The strength requirements of the index plate to withstand such movement under high operational speeds necessitate a high inertial mass in the plate which, in turn, limits the time required for the indexing operation. In addition, the necessity for axial movement of a relatively heavy index plate during the terminal portion of each heading tool ram stroke contributes to an increased dwell time.

It is apparent, therefore, that although rivet making machines have achieved a highly refined state of development, there is need for improvement particularly for increasing the production rates of such machines while retaining present high standards of production quality.

SUMMARY OF THE PRESENT INVENTION

In accordance with the present invention, the production speed limitations of machinery for making shaped articles are materially reduced by mounting head forming dies on a bed supported and thus fixed die shoe, mounting body punch tools in alignment with the respective head forming dies on a reciprocally driven ram and supporting a plurality of discrete blank holding body dies on a light-weight indexing plate or disc in a manner permitting independent axial movement of each body die relative to the disc and to the fixed head forming dies. The body dies, which are preferably of washer-like configuration, thus "float" axially with respect to the rotatably indexed disc but are positioned in precise alignment at each of a succession of working stations at which the respective heading dies and body punches are in alignment. Axial positioning of the body dies is controlled by abutment surfaces on a fixed retaining plate positioned on the front or ram side of the indexing plate and by a combination of abutment surfaces provided either on a fixed rear retaining plate or by heading tool conformation. Body die return means is provided at appropriate working stations where needed.

Because of the axially fixed condition of both the head forming dies and the indexing plate, head forming operations work the metal of blank about the rear side of each body die, thus leaving the front side of each body die available to function as a cutting edge capable of cooperation with a shearing die located at a blank cutting station to which a continuous wire or rod of blank material is fed. Thus dual function of the body die not only contributes significantly to blank length accuracy and to a reduction in dwell time required for the blank cut off and loading operation, but also enables the head working surface portion of each die to be independent of the shearing edge portion thereof for blank cut off. As a result, the head shaping surface portions of each die may be non-cutting and thus rounded or otherwise shaped to achieve any desired surface configuration in the region of the juncture of the head and shank of a rivet or other article to be formed. Moreover, the body dies in the machine of the present invention are readily removable and replaceable as required to achieve optimum operating conditions.

Among the objects of the present invention are therefore: the provision of high speed machinery of the type known in the art as rivet making machines and capable of producing shaped articles such as rivets, screws, bolts and the like; the provision of such a rivet making machine in which the inertial mass of moving parts is minimized; the provision of such a machine which is readily adaptable to forming any of several head and shank configurations in shaped metal articles of the type mentioned; the provision of such a machine in which blank working and shaping stresses are isolated from the mechanism employed for blank transfer; the provision of such a machine in which all blank working components are easily replaceable; the provision of such a machine which facilitates blank cut-off and loading; and the provision of such a machine by which production speeds are materially increased over presently available machinery without compromise of such factors as machinery cost, power consumed in operation or production quality.

Other objects and further scope of applicability of the present invention will become apparent from the detaild description to follow taken in conjunction with the accompanying drawings in which like parts are designated by like reference numerals.

DETAILED DESCRIPTION OF THE PREFERRED EMBODIMENT

Figure 1:
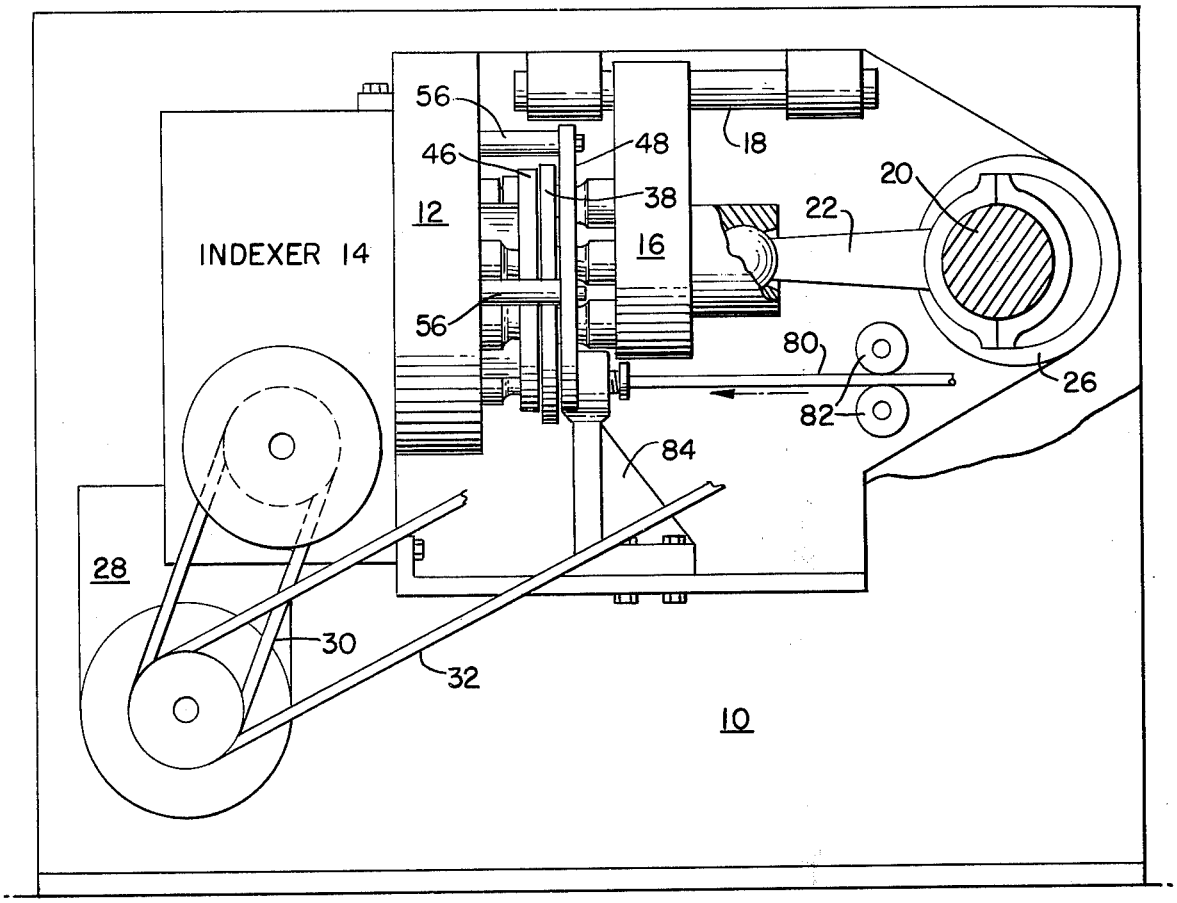
FIG. 1 is a side elevation of the rivet making machine of the present invention.
Figure 2:
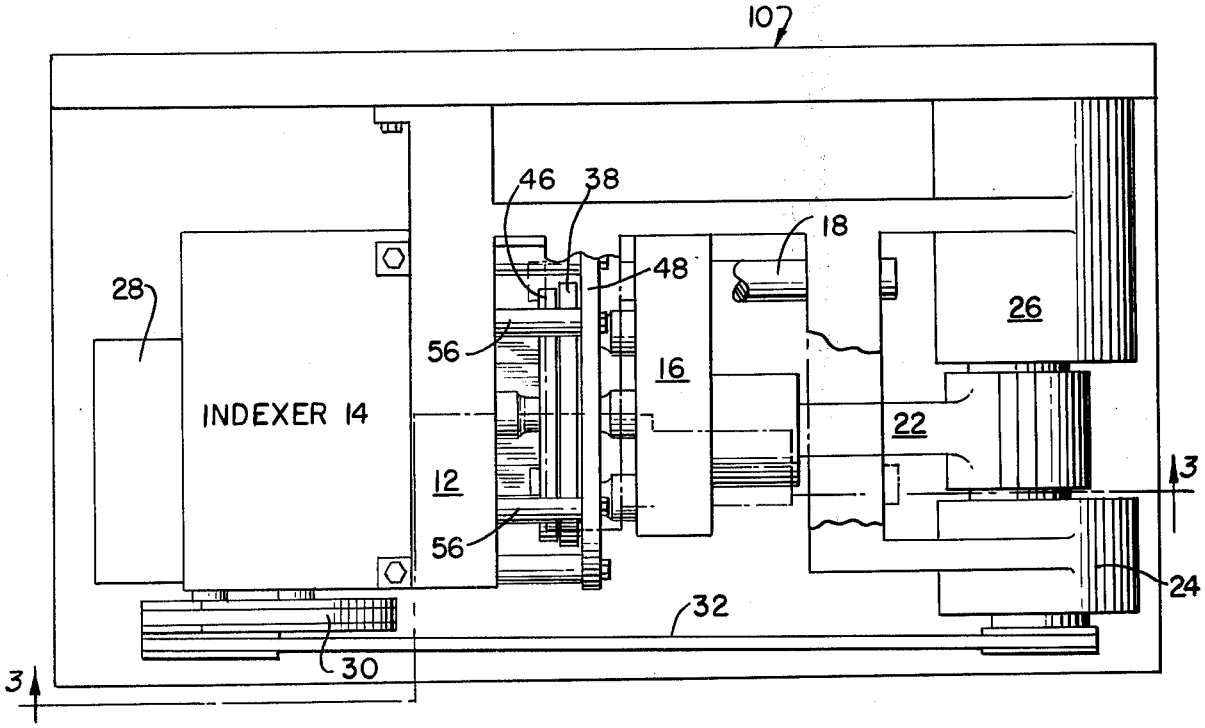
FIG. 2 is a plan view of the machine.
Figure 3:
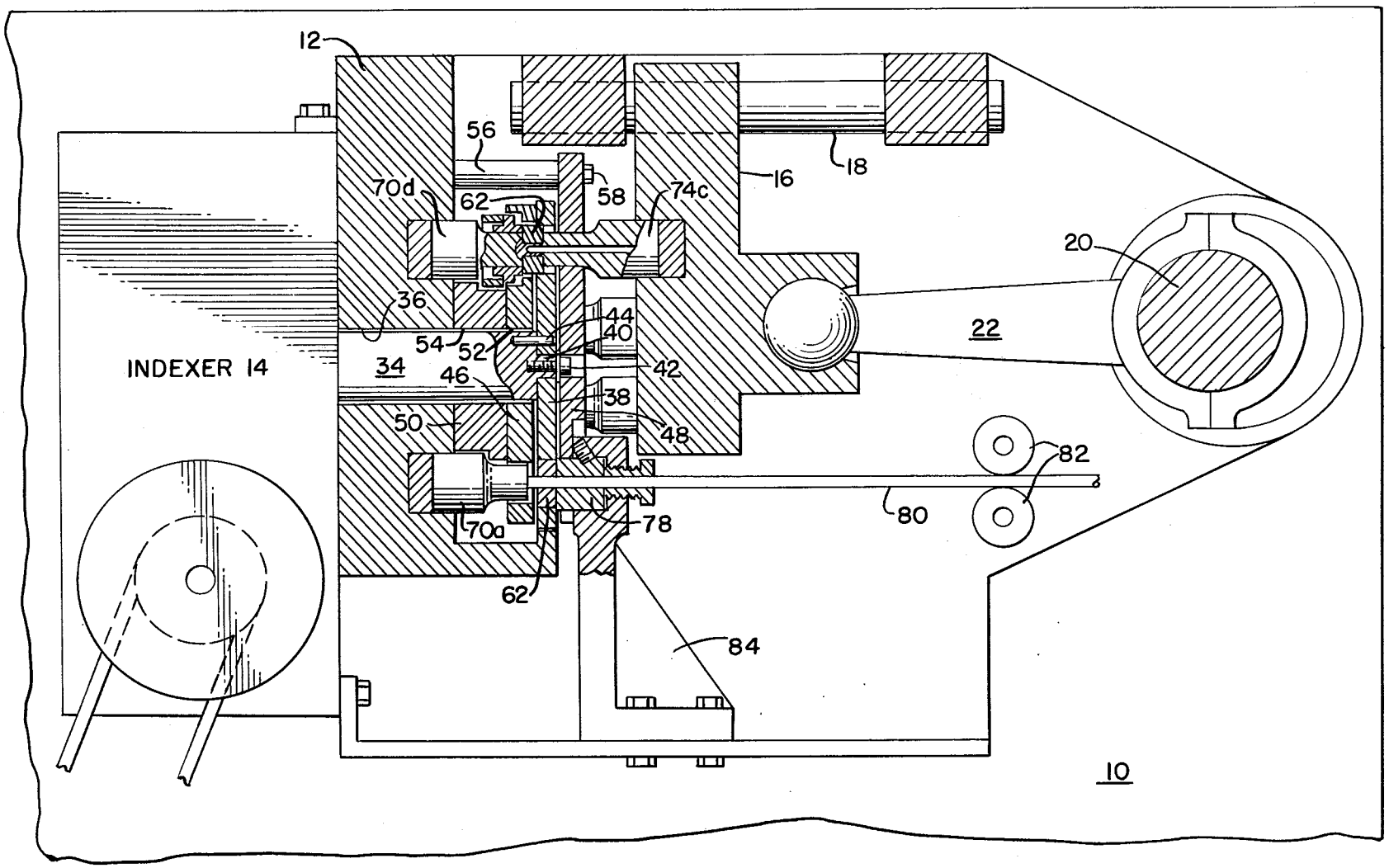
FIG. 3 is an enlarged fragmentary cross-section taken on line 3—3 of FIG. 2.

In FIGS. 1–3 of the drawings, the general organization of the improved rivet making machine of the present invention is shown to include a frame or chassis 10 supporting a vertically oriented fixed or stationary bed 12, an indexer 14 supported to the rear of the fixed bed 12 and a ram 16 supported for reciprocal movement along a horizontal axis by fixed guide rods 18. Reciprocal movement of the ram 16 along the guide rods 18 is effected by a crankshaft 20 and pitman 22, the crankshaft 20 being journalled in bearings 24 and 26 fixed to the machine frame 10. A common source of power such as a motor 28 is mounted on the frame 10 to drive both the indexer 14 and the crankshaft 20 by appropriate transmission means depicted by the pulley belts 30 and 32 respectively in FIGS. 1 and 2 of the drawings. Although the components thus described and their organization on the frame 10 are important to operation of the machine of the present invention, these components, in and of themselves, are well known in the art and may take a variety of alternative forms other than that illustrated in the drawings without departure from the present invention.

As shown most clearly in FIG. 3 of the drawings, an indexing shaft 34 extends from the indexer 14 through a circular bore 36 in the fixed bed 12 and carries at its forward end an indexing disc 38. The disc 38 is mounted on a concentric boss 40 on the end of the shaft 34 by an axial bolt 42 and fixed for angular movement with the shaft 34 by an eccentric dowel pin 44. The disc 38 is positioned axially between a rear retainer plate 46 and a front retainer plate 48, both of which are fixed against radial or lateral movement as well as against axial or longitudinal movement with respect to the bed 12. In particular, the rear retaining plate 46 is secured against the forward face of a heading die shoe 50 in turn secured against the forward face of the bed 12 by suitable means such as bolts (not shown) in such a manner that central bores 52 and 54 in the rear retaining plate 46 and the heading die shoe 50, respectively, form an extension of the bore 36 in the fixed bed 12 through which the indexing shaft 34 extends. The front retaining plate 48 is similarly secured against angular and axial movement with respect to the bed 12 by a plurality of mounting posts 56. Securement of the plate 48 to the post 56 is preferably by bolts 58 or other suitable connecting devices by which removal of the plate 48 from the posts 56 is facilitated for reasons which will become more apparent from the description to follow below. It will be apparent from this description and the organization illustrated in FIG. 3, however, that movement of the disc 38 is confined to rotatable indexing movement with the shaft 34 under the control of the indexer 14 which may, in itself, be any of several well known, high speed, rotatable indexing devices capable of being driven in synchronism with reciprocation of the ram 16.

Figure 4:
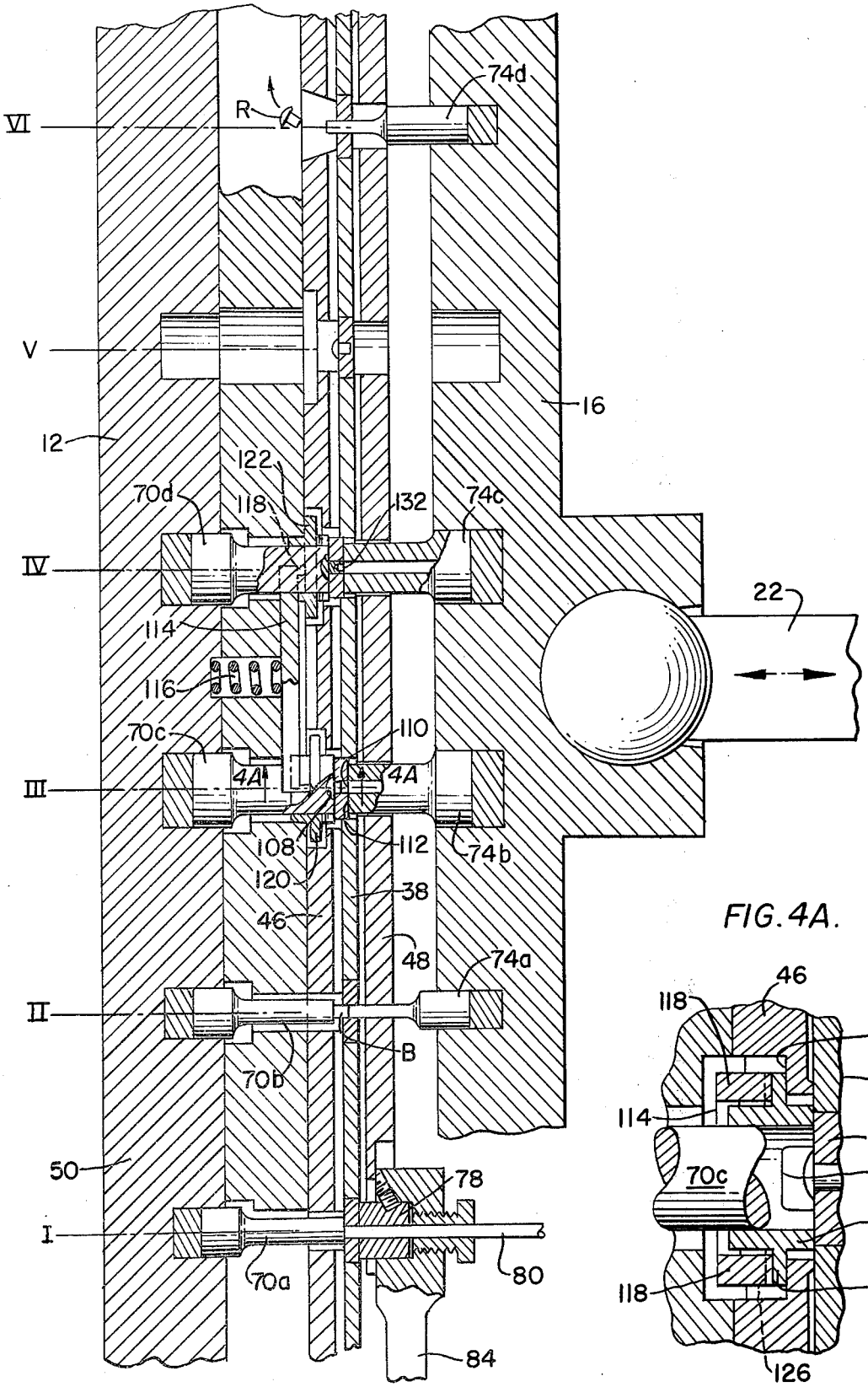
FIG. 4 is a straight line development in fragmentary cross-section illustrating components at successive work stations of the rivet making machine of the present invention.
Figures 5, 6, 7, 8, 9:
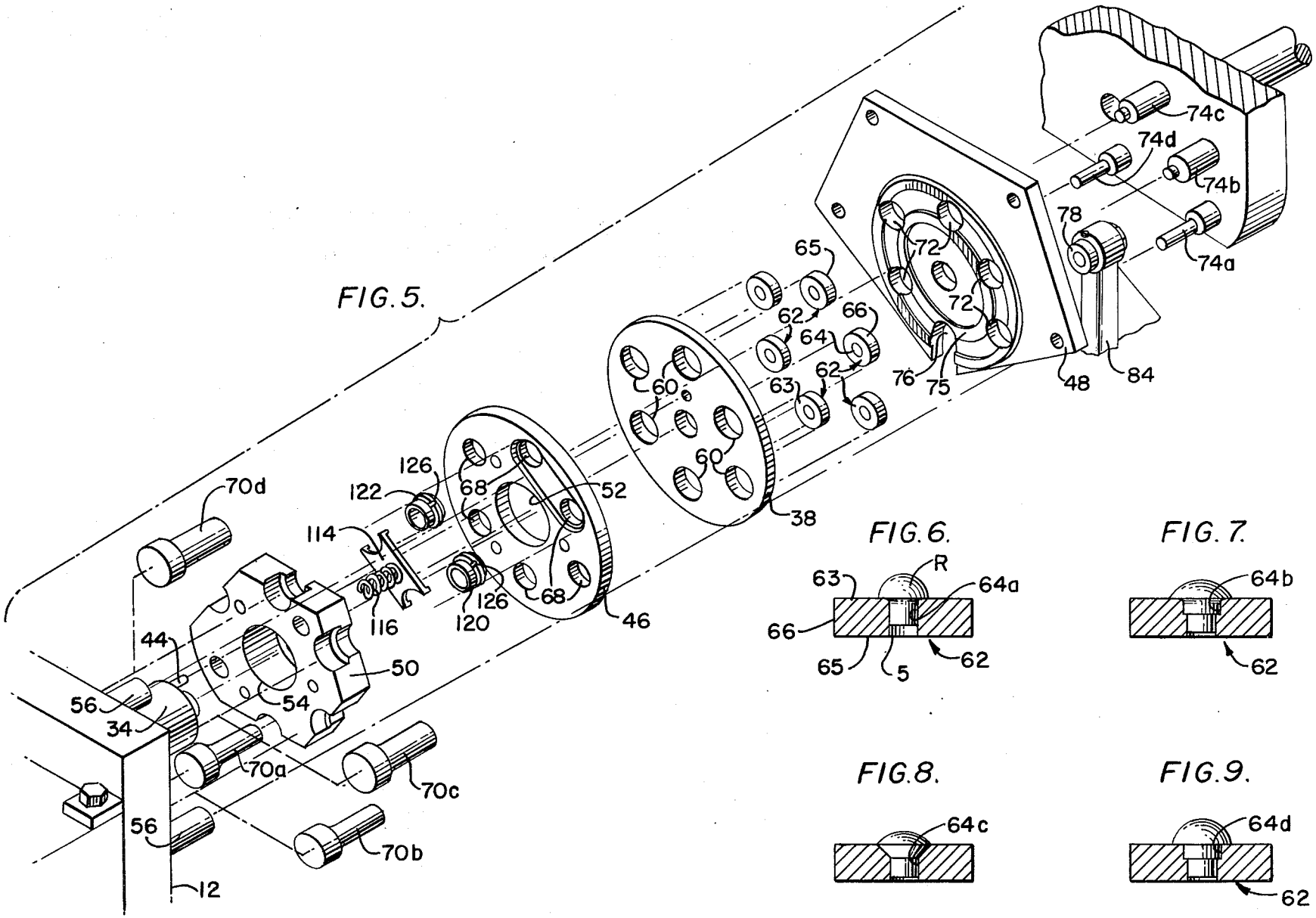
FIG. 5 is an exploded perspective view illustrating the major working parts of the machine of the invention.
FIGS. 6 through 9 are similar cross-sectional views of alternative body die configurations usable with the machine of the present invention.

As shown in each of FIGS. 3, 4 and 5 of the drawings, the indexing disc 38 is provided with a plurality (six in the disclosure embodiment) of equiangularly spaced circular apertures 60 for receiving a like number or set of body dies 62 which, in the disclosed embodiment, are of washer-like configuration to establish in each a rear face 63, an open ended central die cavity 64, a forward face 65 and an outer cylindrical surface 66. In accordance with an important feature of the present invention, the diameter of the outer cylindrical wall portion 66 on each body die 62 is selected to make a close but freely slidable fit with each of the circular apertures 60 in the disc 38. Accordingly, each of the body dies 62 floats in the respective apertures 60 and may be positioned in different axial relationships to the disc 38 independently of others of the body dies. Also, the longitudinal dimension or depth of each body die 62 is the same as the depth or thickness of the disc 38, it being understood that the selection of any desired body die depth is both possible and contemplated. The indexing disc thickness can be equal to or less than the body die depth.

It will be seen by reference to FIGS. 3 and 5 of the drawings that the rear retaining plate 46, which is fixed against any movement with respect to the bed 12 as indicated, is provided with a plurality of apertures 68 spaced to permit concurrent alignment with all of the apertures 60 in the indexing plate 38. Further, a set of heading tools 70*a–d* are mounted in the bed 12 and secured by the die show 50 in a position to extend through the apertures 68 in the rear retainer plate 46. The heading tools 70 are therefore fixedly retained in a stationary position on the bed 12. The size of the respective apertures 68 vary in relation to each other and to the outer diameter of the body dies 62, depending on the particular working operation performed by the heading die tool extending through a particular aperture 68.

The front retainer plate 48 is similarly provided with equiangularly spaced apertures 72 through which a set of body punch tools 74*a–d* may project to cooperate with the heading tools 70. The body punching tools are mounted in a fixed position on the ram 16 and thus are capable of reciprocating longitudinal movement with the ram and relative to the bed 12 and components mounted thereon. As shown in FIGS. 4 and 5, the diameter of each aperture 72 in the front retainer plate 48 is smaller than the external diameter of any body die 62. Also, the radial position of the apertures 72 is between a pair of machined tracks 75 which serve to fix the plane of the body dies 62 during indexing movement and for other working operations to be described in more detail hereinafter.

At one of the equiangularly spaced positions at which the apertures 72 are located in the front retaining plate 48, a radial slot 76 is formed. As shown in FIG. 3, the slot 76 enables a circular blank cut-off die 78 to be aligned with a body die 62 positioned by the disc 38 to be aligned with the slot 76. In this connection, it will be noted from FIG. 3 that provision is made for feeding a continuous wire or rod 80 of stock material axially of the machine by feed means depicted in FIG. 3 as a pair of pinch rollers 82 which may be either driven continuously or incrementally in synchronism with the ram crank 20 and the indexer 14. The wire stock 80 is threaded through the cut-off die 78 and into a body die 62 when the latter is aligned by the indexing disc 38 with the cut-off shear 78. To establish a cut-off shear pair, the forwardly facing surface of each body die 62 joins with the open ended die cavity 64 in a sharp or abrupt shearing edge S (FIG. 6). It will be appreciated, therefore, that relative lateral movement between the cut-off shear 78 and a body die into which the wire stock is advanced will cause a shearing severance of the stock 80. Such relative movement between the shearing pair established by a body die 62 and the cut-off die 78 may be effected in various ways in the contemplated operation of the machine of the present invention. For example, there the diameter and material of the feed wire 80 permits, it is contemplated that the cut-off die 78 will be retained in a fixed position so that when the wire 80 is advanced through a body die 62 upon its becoming aligned with the cut-off die 78, further indexing movement of the disc 38 will bring about the relative movement of shearing edges required to cut the wire. Thus in the embodiment of FIGS. 1–3, the blank cut-off die 78 is secured in a stationary bracket 84 bolted or otherwise suitably affixed to the frame 10 of the machine.

Figure 10:
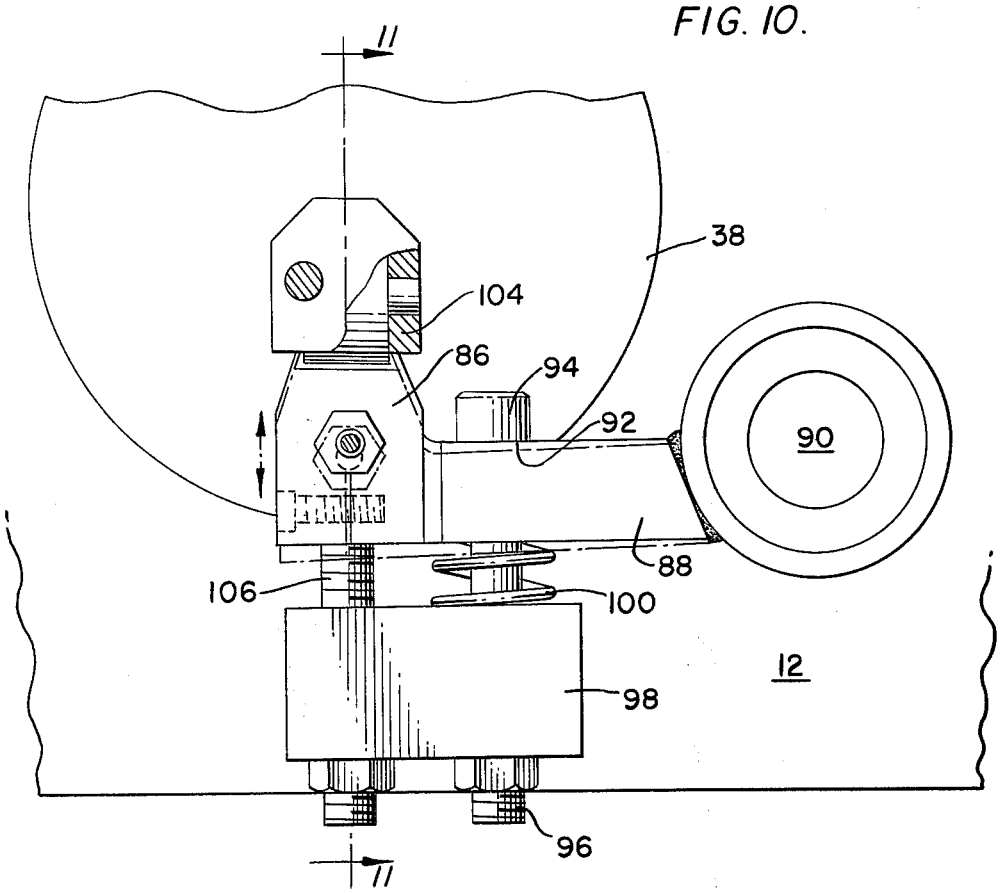
FIG. 10 is fragmentary front elevation illustrating a modified stock material cut-off mechanism.
Figure 11:
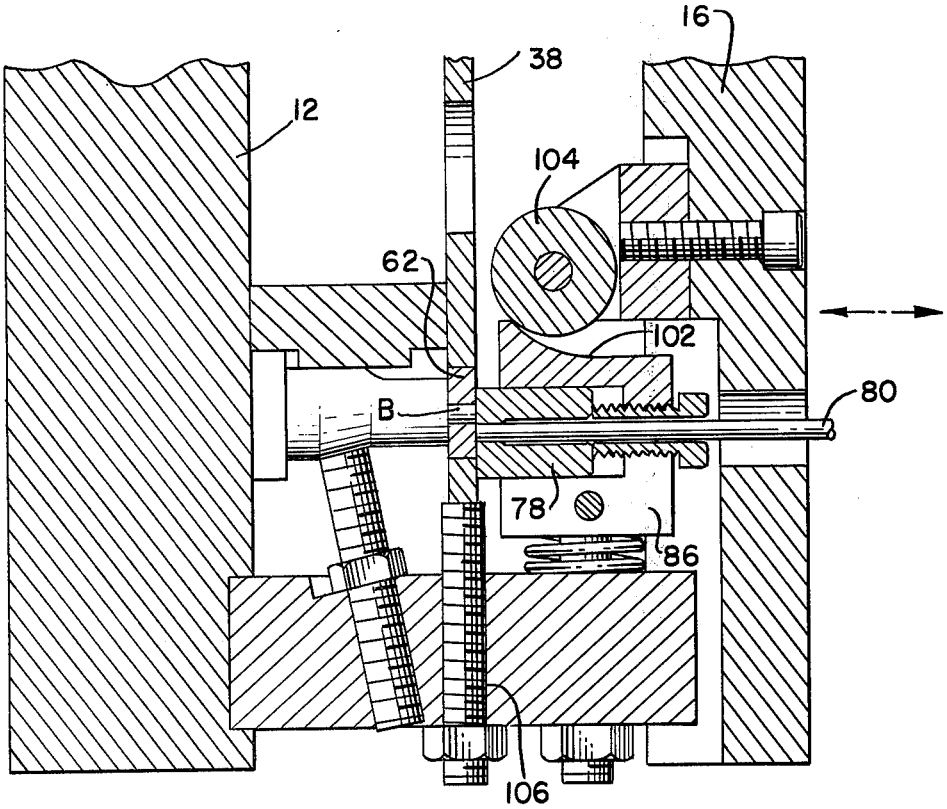
FIG. 11 is an enlarged fragmentary cross-section taken on line 11—11 of FIG. 10.

In an alternative embodiment illustrated in FIGS. 10 and 11 of the drawings, the blank cut-off die 78 is supported in a holder 86 on one end of an arm 88 journalled at its other end on a fixed shaft 90, the axis of which is parallel to the direction of reciprocal movement of the ram 16. The upper position of the arm and thus of the cut-off die 78 is established by an abutment surface 92 on the head 94 of a bolt 96 fixed to a boss 98 on the fixed bed 12. A compression spring 100 biases the arm 88 into engagement with the abutment surface 92 on the bolt head 94. The holder 86 is provided with a cam surface 102 positioned to be engaged by a camming roller 104 supported in an appropriate position on the ram 16. The position of the support 86 and thus of the cut-off die 78 illustrated in FIG. 11 is at the end of a cut-off stroke. Thus the die 78 is displaced with respect to a body die 62 in which a blank B has been severed from the wire 80. An adjustable abutment pin 106 is positioned radially of the indexing disc 38 to absorb the impact of shearing cut-off movement of the die 78. It will be appreciated that upon withdrawal of the ram 16 and thus of the roller 104, the spring 100 will bias the arm 88 and thus the cut-off die 78 upwardly until the arm strikes the abutment surface 92 thus positioning the cut-off die 78 again in alignment with the indexed position of an empty body die 62.

It is contemplated that movement of the cut-off die 78 in the manner of that described with respect to FIGS. 10 and 11, may be achieved in other ways. For example, the die 78 could be supported by a member driven by an independent crank (not shown) and operated in synchronism with the indexer 14 and ram 16. Irrespective of the manner in which the shearing faces of a body die 62 and the cut-off die 78 is carried out in practice, it will be appreciated that because the heading dies 70 operate in conjunction with the rear face of each body die 52 in the head forming operation to be described, the forwardly facing surface of each body die is available exclusively for the blank shearing operation in cooperation with the cut-off die 78.

Structural detail of the heading die tools 70, the punch tools 74 and the manner in which these tools cooperate with each other and with the body dies 62 during operation of the machine of the present invention to form a shaped metal article such as a tubular rivet R is illustrated most clearly in FIG. 4 of the drawings in which the six apertures 60 of the indexing plate 38 are projected to a linear cross-section and depict six working stations I–VI. The stations I through VI represent the six positions to which each body die 62 is indexed by incremental angular movement of the indexing disc 38 during retraction of the ram 16 from its forward or working position illustrated in FIG. 4 to a retracted position and possibly during an initial portion of forward ram movement. The length of time during which the body dies 62 are positioned at each of the stations I through VI constitutes a dwell period in which angular movement or rotational movement of the disc 38 is stopped.

In the example illustrated in FIG. 4, station I is a blank cut-off station at which each body die 62 becomes aligned with the heading tool 70*a* which functions as an abutment stop for linear feed of the wire 80 of stock material. Thus as the body die 62 becomes aligned at station I with the tool 70*a* and the cut-off die 78, the rod 80 is advanced until the end thereof engages the end of the tool 70*a*. Subsequent relative movement of the body die 62 from the station I or relative movement of the cut-off die 78 at station I will effect the severance of the wire 80 to provide a blank B in the die cavity of the body die 62 at this station and in the manner described above.

At station II, the heading die 70*b* is aligned with the punch 74*a* and the body die 62 indexed to this station. The working function performed at station II is that of axially positioning the blank B by radial expansion due to longitudinal compression so that it is expanded into tight engagement with the die cavity of the body die 62 at this station. The position of the blank B thus fixed at station II will be retained throughout further working operations as a result of subsequent indexing of the disc 38.

AT station III, the heading tool 70*c* is aligned with the body punch 74*b*. The tool 70*c* carries at its forward end a heading die cavity 108 into which the blank B is advanced to form a headed conformation. This operation is effected by the punch 74*b* having a central core 110 which extends into the body die cavity to counterbalance the force brought to bear at opposite ends of the blank during the head forming operation at station III. The punch 74*b* also is provided with an annular abutment face 112 which engages the body die at station III to advance it against the heading tool 70*c*. This axial movement of the body die 62 at station III is of course independent of the axial positioning of body dies at the other stations and is possible because of the manner in which the body dies 62 are floated in the indexing disc 38.

Because indexing movement of the disc 38 cannot occur when a body die 62 is displaced axially as at station III, a body die return mechanism or stripper is provided to return the body dies as necessary upon retraction of the ram 16, in this instance at both stations III and IV. In the disclosed embodiment, body die return in this manner is caused by a stripper including a yoke member 114 biased against the action of the ram 16 by a compression spring 116 and having diametrically positioned axial bearing tabs 118 engaging flanged sleeves 120 and 122 positioned concentrically on the heading tools 70*c* and 70*d* at stations III and IV respectively.

Figure 4A:
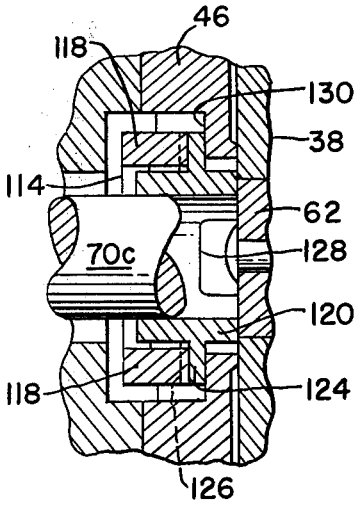
FIG. 4*a* is an enlarged fragmentary cross-section taken on line 4*a*–4*a* of FIG. 4.

As shown in FIGS. 4*a* and 5 of the drawings, although the sleeves 120 and 122 as well as the flanges 124 thereon are circular in configuration, the sleeves 120 and 122 are retained against rotation as a result of the bearing tabs 118 on the striker plate 114 engaging in detents 126 formed at opposite sides of each flange 124. In this manner, a pair of slots or cut outs 128 will be aligned with indexing travel and allow passage of the article head during indexing movement of the disc 38. Also it will be noted that the rear retainer plate 46 is provided with a shoulder or annular ledge 130 to provide a firm bearing for the sleeves 120 and 122. This bearing provided by the shoulder 130 will ensure return of the body die at stations III and IV without any possibility of canting or misaligning the body die upon withdrawal of the ram. Also the positioning of the sleeves 120 on the cylindrical tools 70*c* and 70*d* will ensure true alignment of the body dies with the axis of ram reciprocation during full movement required for operation at stations III and IV.

At station IV, the tool 70*d* is provided with a heading die cavity similar to that provided on the heading tool 70*c* but the ram carried punch 74*c* at station IV is provided with a body hollowing portion 132. The operation at station IV with respect to movement of the body die 62 is similar in all other respects to that described above with respect to stations III.

Station V in the embodiment illustrated is a blank station and as such is devoid of any tools in this instance. It will be appreciated, however, that further working heading dies and punch tools can be provided at this station if needed to form an article of a particular shape. At station VI, the body dies become aligned with an ejecting punch 74*d* carried by the ram 16. Upon advance movement of the ram, the punch 74*d* will pass through the cavity of the body die 62 to eject a finished article R as shown.

In light of the foregoing, it will be appreciated that after each of the six body dies 62 in the disclosed embodiment has passed the blank cut-off station I, a finished article R will be ejected for each reciprocating stroke of the ram 16. Because of the location of the heading tools 70 in a fixed position behind the indexing plate 38 as well as the manner in which the body dies 62 are floated in the indexing plate 38, the forces exerted by the ram 16 are isolated completely from the indexing plate 38 and shaft 34. Thus the mass which must be moved in increments between the respective working stations I–VI is confined to a minimum, allowing extremely high speed indexing of the plate 38, and reciprocal operation of the ram 16.

In addition, the facility offered by each body die to function as a cut-off shear enables the blank forming operation to be effected quickly and commensurate with extremely high speed overall machine operation without in any way restricting variations in head conformation. Thus in FIGS. 6–9 of the drawings, the body dies 62 are shown with four alternative forms of die cavities 64*a*–64*d*. In each instance, the die cavity 64 joins with the forwardly facing surface 65 at the sharp shearing edge S. The opposite end of the die cavity 64 joins with the rear surface 63 in a manner dictated solely by the head conformation desired. Thus in FIG. 6, a filleted juncture between the shank and head of a rivet R is provided whereas a shoulder rivet is shown in FIG. 7 and a counter sunk rivet in FIG. 8. In FIG. 9, a carriage bolt head is depicted on an article which though shown as a rivet, could be a carriage bolt of greater length, it being understood that the greater length would necessitate a depth or thickness of body die greater than that shown in FIG. 9. Moreover, interchangeability of the alternative dies shown as well as different indexing plates 38 is facilitated by the removable mounting of the front retainer plate 48. Various thicknesses of the body dies 62 can be accommodated by substitution of the mounting posts 56 without modification of other parts.

The articles described with respect to FIGS. 6–9 and in the context of general operation of the machine of this invention are most commonly made from metal blanks. It is contemplated, however, that the machine may be used to form headed articles from other materials such as plastics, fibrous composites and the like.

Thus it will be seen that by this invention there is provided an improved rivet making machine by which the above mentioned objects are completely fulfilled. Also it will be appreciated from the foregoing description and the illustrations of the accompanying drawings that modifications may be made in the disclosed embodiment without departure from the invention. It is expressly intended, therefore, that the foregoing description is illustrative of preferred embodiments only, not limiting, and that the true spirit and scope of the present invention be determined by reference to the appended claims.

I claim:

1. A rivet making machine comprising:

means supporting a stationary set of working tools at laterally spaced stations;

ram means for supporting a reciprocable set of working tools at said laterally spaced stations to be in axial alignment with said stationary set of working tools and cooperable therewith to apply working force to opposite ends of a blank positioned at one or more of said stations upon axial advancing movement of said reciprocal set toward said stationary set;

an indexing plate interposed between said sets of working tools and in an axial position fixed with respect to said stationary set;

a set of body dies carried by said indexing plate for incremental lateral movement between said stations, each body die of said set of body dies having an axial, open-ended die cavity and being independently movable in an axial direction relative to said plate, whereby each such body die and a blank located in the die cavity thereof may be advanced axially by any one of said reciprocal set of working tools into working engagement with a corresponding one of said stationary set of working tools at any one of said stations; and means supported independently of said indexing plate to axially position said body dies relative to said indexing plate during lateral indexing movement thereof.

2. The apparatus recited in claim 1 in which one end of each of said body dies establishes with a corresponding one end of said body die cavity, a shearing edge and in which the other and opposite end of said body die defines a head forming die conformation with the other end of said die cavity.

3. The apparatus recired in claim 2 including means to feed linear stock material in axial alignment with one of said stations and into the die cavity of one of said body dies positiond at said one station in a direction proceeding from said one end to said other end of said one body die, and a shearing tool at said one station cooperable with said shearing edge upon relative lateral shearing movement of said shearing tool and said shearing edge to sever a blank from the portion of said stock material in the die cavity of said one body die.

4. The apparatus recited in claim 3 in which said shearing tool is stationary, said relative lateral shearing movement being effected by indexing movement of said on body die with said indexing plate.

5. The apparatus recited in claim 3 wherein said shearing tool is supported for lateral movement with respect to said one station, said relative shearing movement being effected by movement of said shearing tool while said one body die is retained at said one station by said indexing plate.

6. The apparatus recited in claim 5 including camming means for moving said shearing tool out of axial alignment with said station upon advancing movement of said ram means and said reciprocable set of working tools.

7. The apparatus recited in claim 3 in which said stationary set of working tools includes head forming dies and in which said reciprocable set of working tools includes body punches, said one end of said body dies facing said reciprocable set and said other end of said body dies facing said stationary set.

8. A rivet making machine comprising:

means supporting a stationary set of working tools at laterally spaced stations;

ram means for supporting a reciprocable set of working tools at said laterally spaced stations to be in axial alignment with said stationary set of working tools and cooperable therewith to apply working force to opposite ends of a blank positiond at one or more of said stations upon axial advancing movement of said reciprocal set toward said stationary set;

an indexing plate interposed between said sets of working tools and in an axial position fixed with respect to said stationary set;

a set of body dies carried by said indexing plate for incremental lateral movement between said stations, each body die of said set of body dies having an axial, open-ended die cavity and being independently movable in an axial direction relative to said plate, whereby each such body die and a blank located in the die cavity thereof may be advanced axially by any one of said reciprocal set of working tools into working engagement with a corresponding one of said stationary set of working tools at one of said stations; and means to position said body dies in pre-established axial relation to said indexing plate during lateral indexing movement thereof, said last mentioned means comprising plate means to establish a planar tracking surface between said reciprocable set of working tools and said indexing plate.

9. The apparatus recited in claim 8 including stripping means for returning any of said body dies advanced by said reciprocable working tools to an indexing position against said tracking surface upon axial retracting movement of said reciprocable set.

10. The apparatus recited in claim 9 wherein said stripper means comprises at least one sleeve member having a radial flange projecting therefrom, means to advance said sleeve against a body die aligned therewith in the direction of retracting movement of said reciprocable set and axially fixed abutment means for engagement by said flange.

11. A rivet making machine for forming headed articles from blanks cut from linear stock, said machine comprising:

a fixed bed supporting a set of angularly spaced stationary head forming tools;

reciprocable ram means supporting a set of body end working tools in axial alignment with said head forming tools, respectively;

an indexing disc in a stationary axial position between said head forming tools and said body end working tools, said indexing disc being rotatable in increments corresponding to the angular spacing of said head forming tools, each such increment of disc movement corresponding to the angular spacing between successive working stations at which said tools are aligned;

a plurality of body dies, each having a blank receiving die cavity open at opposite ends, said body dies being supported by said indexing disc for angular indexing movement therewith successively to said working stations but axially movable in said indexing disc independently of each other, whereby movement of said body end working tools against said body dies, blanks retained therein and said head forming tools will effect an axial displacement of the blanks and said body dies as required to effect head forming deformation of said blanks against said head forming members; and means supported independently of said indexing disc to axially position said body dies relative to said indexing plate during lateral indexing movement thereof.

12. The apparatus recited in claim 11 wherein said body dies are of washer-like configuration to define circular front and rear surfaces at opposite ends of and concentric with said die cavity in each body die, said front and rear surfaces facing respectively said reciprocable ram means and said fixed bed.

13. The apparatus recited in claim 12 wherein said circular front surface of each of said body dies defines a shearing edge with said die cavity and wherein the rear surface of each of said body dies defines a head forming die conformation with said die cavity.

14. The apparatus recited in claim 13 including means for feeding linear stock material in axial alignment with one of said stations and into the die cavity of one of said body dies positioned at said one station in a direction proceeding from said front to said rear body die surfaces and a shearing tool at said one station cooperable with said shearing edge upon relative lateral shearing movement of said shearing tool and said shearing edge to sever a blank from the portion of said stock material in the die cavity of said one body die.

15. The apparatus recited in claim 14 including means to support said shearing tool in a stationary position at said one station, said relative shearing movement being effected by indexing movement of said one body die with said indexing disc.

16. The apparatus recited in claim 14 including means for supporting said shearing tool for lateral movement with respect to said one station, said relative shearing movement being effected by movement of said shearing tool while aid one body die is retained at said one station by said indexing disc.

17. The apparatus recited in claim 16 wherein said shearing tool supporting means comprises an arm pivotally supported on an axis parallel to the direction of reciprocation of said ram means, and cam means cooperable with said ram means for displacing said shearing tool laterally with respect to said one body die.

18. A rivet making machine for forming headed articles from blanks cut from linear stock, said machine comprising:

a fixed bed supporting a set of angularly spaced stationary head forming tools;

reciprocable ram means supporting a set of body end working tools in axial alignment with said head forming tools, respectively;

an indexing disc in a stationary axial position between said head forming tools and said body end working tools, said indexing disc being rotatable in increments corresponding to the angular spacing of said head forming tools, each such increment of disc movement corresponding to the angular spacing between successive working stations at which said tools are aligned;

a plurality of body dies, each having a blank receiving die cavity open at opposite ends, said body dies being supported by said indexing disc for angular indexing movement therewith successively to said working stations but axially movable in said indexing disc independently of each other, whereby movement of said body end working tools against said body dies, blanks retained therein and said head forming tools will effect an axial displacement of the blanks and said body dies as required to effect head forming deformation of said blanks against said head forming members, said body dies being of washer-like configuration to define circular front and rear surfaces at opposite ends of and concentric with said die cavity in each body die, said front and rear surfaces facing respectively said reciprocable ram means and said fixed bed; and front and rear stationary retaining plates mounted on said fixed bed and having guide surfaces to retain said body dies in a common radial plane during indexing movement thereof by said indexing disc.

19. The apparatus recited in claim 18 in which said front retaining plate is formed having apertures extending through the guie surface on said front retaining plate, each of said apertures being smaller in diameter than the circular front face of each of said body dies so that the guide surface on said front retaining plate is operative to retain said body dies against forward movement from said radial plane at said stations.

20. The apparatus recited in claim 18 wherein the guide surface on at least said front retaining plate is established by axially projecting concentric tracks located on opposite radial sides of said apertures.

21. In a rivet making machine having a stationary set of working tools at angularly spaced stations, a reciprocable set of working tools in axial alignment with the stationary set and cooperable therewith to apply working force to opposite ends of a blank positioned at one or more of the stations upon axial advancing movement of the reciprocal set toward the stationary set, a blank transfer mechanism comprising:

an indexing disc;

means supporting said indexing disc in a stationary axial position and for incremental rotation to successive dwell positions of alignment with the angularly spaced stations;

a set of body dies carried by said indexing plate for incremental angular movement therewith between dwell positions at which each of said body dies is positioned at one of the stations, each body die of said set of body dies having an axial, open ended die cavity and being independently movable in an axial direction relative to said disc; and means supported independently of said indexing disc to position said body dies in a common preestablished axial position relative to said indexing disc during incremental rotation thereof to successive dwell positions.

22. The apparatus recited in claim 21 wherein said die cavity defines a head forming die conformation at one end and a shearing edge at the other opposite end.

* * * * *

UNITED STATES PATENT OFFICE
CERTIFICATE OF CORRECTION

Patent No. 4,019,432 Dated April 26, 1977

Inventor(s) Albert Dunkin

It is certified that error appears in the above-identified patent and that said Letters Patent are hereby corrected as shown below:

Column 3, line 66, "detaild" should be --detailed--.

Column 5, line 43, "show" should be --shoe--.

Column 6, line 24, "there" should be --where--.

Column 7, line 49, "AT" should be --At--.

Column 12, line 5, "aid" should be --said--.

Column 12, line 53, "guie" should be --guide--.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*